United States Patent [19]

van Roon

[11] Patent Number: 4,535,713

[45] Date of Patent: Aug. 20, 1985

[54] LAYOUT OF A SHIP STEERING-HOUSE

[76] Inventor: Johannes van Roon, A 74, 2975 BC Ottoland, Netherlands

[21] Appl. No.: 590,531

[22] Filed: Mar. 20, 1984

Related U.S. Application Data

[63] Continuation of Ser. No. 407,814, Aug. 13, 1982, abandoned, which is a continuation of Ser. No. 170,973, Jul. 18, 1980, abandoned.

[30] Foreign Application Priority Data

Jul. 20, 1979 [NL] Netherlands ..... 7905665

[51] Int. Cl.[3] ..... B63B 29/00

[52] U.S. Cl. ..... 114/71; 114/270

[58] Field of Search ..... 114/270, 71; 244/1 R, 244/118.5, 129.1; 73/432 AD; 180/90; D12/192; 105/456

[56] References Cited

U.S. PATENT DOCUMENTS 3,314,178 4/1967 Sayler ..... 40/130

3,572,615 3/1971 Firestone ..... 244/129.1 X

FOREIGN PATENT DOCUMENTS 846038 9/1939 France .

1536600 8/1968 France .

7413755 4/1975 Netherlands .

OTHER PUBLICATIONS

German Journal, "Schiff und Hafen", vol. 3, 1971, pp. 188–189.

*Primary Examiner*—Sherman D. Basinger

*Attorney, Agent, or Firm*—Martin Smolowitz

[57] ABSTRACT

A steering-house for a vessel is described, in which all instruments, displays, etc. to be read visually, are concentrated left and right of the main radar screen in an instrument or reading unit placed under the steering-house ceiling in front of the skipper. The unit is visible by the seated skipper at an angle between 15° and 30° upward from his horizontal plane of vision, permitting an unobstructed view roundabout. The instrument unit may be movably supported to lower it unto or below the horizontal plane of vision. The controls to be adjusted by hand (or by feet) are concentrated in floor-mounted consoles to the left and right of the skipper and are within handreach.

13 Claims, 4 Drawing Figures

LAYOUT OF A SHIP STEERING-HOUSE

This is a continuation of Ser. No. 407,814 filed Aug. 13, 1982, which is a continuation of Ser. No. 170,973 filed July 18, 1980, both now abandoned.

BACKGROUND OF INVENTION

The invention is concerned with a steering-house for a ship or other floating vessel, more specially for an inland ship or small sea-going ship, provided with means to command the ship and for the navigation and the control of the different functions in the ship, in which the commandment means mainly are situated in front of and to both sides of the commander in floor-mounted consoles, and in which the radar screen(s) are placed in front of the commander, whereas a minor number of the means are fitted to the ceiling of the steering-house (like the radio, the intercom, mirrors of magnetic reflection compass, etc.), and with at least a centrally placed chair for the commander.

In the prior art there is revealed a lay-out for a steering house of a sea-going vessel which is intended to keep the functions of commandment, navigation and control of the different ships-functions separated. This is partly due to requirements imposed by the shipping inspections and the classification bureaus to the responsibilities of the respective crew members on a sea-going vessel and to the required minimum number of persons on the bridge. Within these limits, one tries to design a lay-out according to modern ergonometric points of view. It is a follow-up of what has grown since years in the inland shipping trade. For the smaller sea-going vessels, however, and for the inland shipping it is generally possible to rely on a one-man control, and the present invention aims to optimize this desire. Especially in crowded harbours and on inland waters with dense traffic, it is desirable to divert the attention of the commander as little as possible, for instance by having him visually find and read said different navigation and control means. The commander generally looks in a horizontal plane forward and round about and shall have to be able to find the greater part of said means for visual inspection without having to turn his head and without having to change his direction of view over more than a small angle. The means for the control, especially those for the commandment, consist of levers, pushing knobs and switches and are actuated with hands and feet. The commander shall have to be able to do this while in a seated position. Acoustical communication, of course, can take place from any place, but oral communication by the commander shall nevertheless have to take place near to his mouth or throat.

SUMMARY OF INVENTION

To achieve this object, the steering-house according to the invention is characterized in that an integrated reading unit including the main radar screen(s) and at least all essential means supplying visual information for the navigation and the control of a ship are placed at both sides of the screen(s) under the roof in front of the commander, and the control means for the commandment of the ship are situated within hand reach of the seated commander, all the above in such a way that all means to be read visually are mainly placed perpendicular with respect to the direction of view of the commander so that the commander has a free field of view round about him and more specially in forward directions.

The lay-out of the steering-house according to the invention is no more mainly functional according to command, navigation and control considerations, but also according to human functioning, more specially the visual functions and the touch- or feel-function respective to the control function. Generally it is required for a good view by the commander that, when seated in the commander's chair, he will have a free vision at an angle of up to about 15° upward from the horizontal plane through his eyes. In order to be able to see the deck of the ship, and, during maneuvering, see near-by obstacles, a free angle of vision of at least 30° downward should also be available. From ergonometric research it was derived, that also an angle of 30° upward can be considered as useful, without being tiring for the man. According to the invention, the hitherto unused part of the free angle of vision between 15° and 30° upward will now be used to position in it at least all navigation and control instrument essential and more specially all means which require visual reading or observation. These means are the main radar screen and possibly other radar- and other display screens, different indicating instruments for the control of functions of the vessel, like rudder-position-indicator, working-condition data of the engines, etc., curve-indicator, compass display, echo-sounder display, etc. Apart from these it is already customary to install between others radio-intercom installations etc. to the roof. In doing so the commander can throw a glance on all these means to be read visually, without having to turn his head and read the instrument in one single glance.

Thanks to this integrated reading unit arrangement, in the customary vertical consoles in front of and at both sides of the commander, much space becomes available, so that practically all commandment means to be controlled by hand can now be situated within hand reach of the seated commander. All visual readings can be done fast and in a certain pattern within the angle of view which is recommanded from an ergonometric point of view, perpendicular to the direction of view, both in vertical as well as in horizontal direction. An additional advantage is formed by the fact that the radar screen can be used during daytime as a "periscope" or "retro-visor". Since the control consoles or control desks can be made smaller than hitherto, they will disturb to a lesser extent the view in a forward direction. Also the floor space of the steering-house, thanks to the new position of the radar display screen in front and at both sides of the commander can become smaller, which also improves the view from a high positioned steering-house above a ship deck.

According to a further characteristic of the invention, the indicating means, between them including one or more radar screens, can be united into one reading unit with a mainly sperical-sector shaped surface, and that this unit may be movable up and down in front of the commander with the help of guiding means, like at least one rod quadrangle, between a position against the roof of the steering-house, a position which generally is in the same horizontal level as the center of view of the commander (in case of "blind navigating") and eventually a still lower position. The above can all be accomplished in such a way, that the guiding means maintains the reading unit during its up and down movement continuously perpendicular to the direction of view of the commander, keeping the distance between the commander and the indicating or reading means also generally constant.

It can be considered as an advantage of said vertically movable reading unit, that the commander can position the unit in an optimal way in front of him, for instance adapted to his size. A further and important advantage is that in case of absolute "blind navigation", like in air traffic is customary, the unit can be positioned in the horizontal plane in front of the center of view of the commander. There are different well-known guiding means, like for instance an adapted quadrangle of rods, to keep the unit perpendicular to the direction of view of the commander in all positions. It is furthermore possible to make the unit, preferably the radar apparatus slidable in lengthwise direction. This may be of importance when nearing a port or lock in a region with much water traffic and under bad conditions of visibility. Apart from this it is also possible to make the commander's chair slidable in lengthwise direction of the vessel.

It will be clear that the navigation and control means which are positioned according to the invention in dependence of the human senses, will have to be arranged in their group in a systematic and functional way. For instance a second rader screen may be positioned on the roof-ceiling such that the commander is not disturbed by it and that a second commander can read it clearly from his position.

BRIEF DESCRIPTION OF DRAWINGS

With the help of the following description of the attached drawings of a preferred embodiment of the steering-house, the invention will be explained more in detail.

DESCRIPTION OF INVENTION

Figure 1:
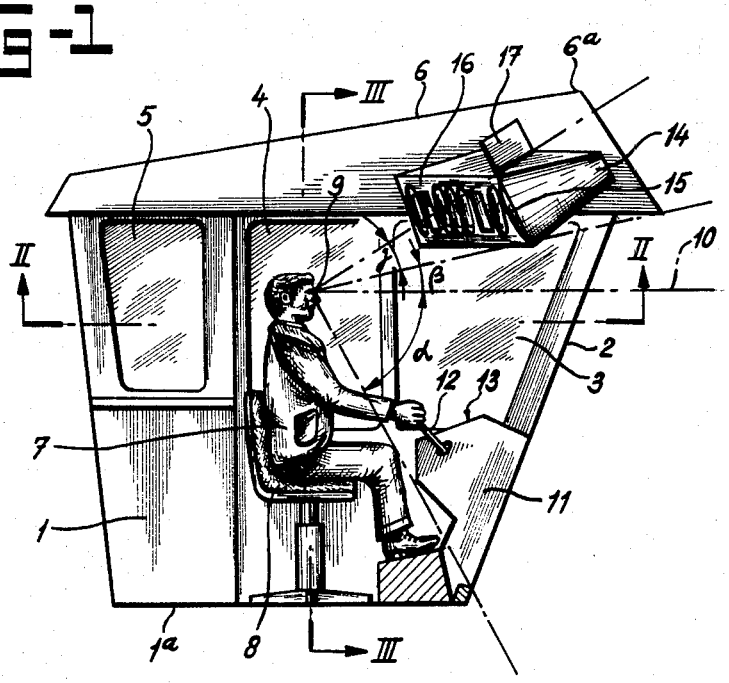
FIG. 1 shows in side view partly in cross-section of a steering-house according to the invention.

In FIG. 1 the whole steering-house is indicated with 1, which has a large slanting window 2 at its front side, whilst at the sides slanting windows 3, 4 and 5 are fitted as well the windows all slanting outwardly at their upper ends. The steering-house is closed at its top side by a roof 6, which forms inside the roof-ceiling of the steering-house. The roof 6 extends from a highest point near the front side 6*a* backwards and sloping downwards to provide a useful space at the front side of the steering-house. The commander 7 has a fixed position on a raised commanding chair 8. The commanding chair is adjustable in vertical direction, so that each commander, independent of his height, can adjust his center of view 9 approximately on the same place. The horizontal plane 10 through the center of view 9 is situated in such a way with regard to the front window 2, that a free field of view in downward direction with an angle $\alpha$ of approximately 45° is available. The necessary angle of view $\beta$ above the horizon 10 amounts to approximately 15°, until which height the front window 2 is extended in upward direction up to the rim of the roof of the steering-house. From ergonometric tests it is known, however, that a human being not only in downward direction but also in upward direction possesses over a good angle of visibility of 30°, resulting in an angle $\gamma$ which is still useful above the earlier mentioned angle $\beta$. The free space below the roof-ceiling can be accommodated in this angle $\gamma$, and can take the instruments for reading, intended for navigation and control of the ship.

Beyond the downward directed angle of view $\alpha$, a console 11 is situated, in which and on which the necessary means for performing the command are placed, like levers 12, control-switches and control-buttons 13. Since the greater part of all visually readable instruments are fitted on the ceiling, the panel or desk of the console 11 may be relatively small and can remain within hand-reach of the seated commander in front of him at both his sides. Against the roof-ceiling a central radar apparatus 14 with screen 15 is fitted. Beside it, there is a panel 16 with a number of visually readable instruments, like a rudder-position indicator, operating data of the engines, pitch of a controllable propeller, the indicating instrument of an echo-sounder, etc. are fitted. All instruments in the panel 16, including a radar screen 15 and the curve indicator 17, are placed such that their reading surface will be perpendicular to the direction of view of the commander from his center of vision 9.

Figure 2:
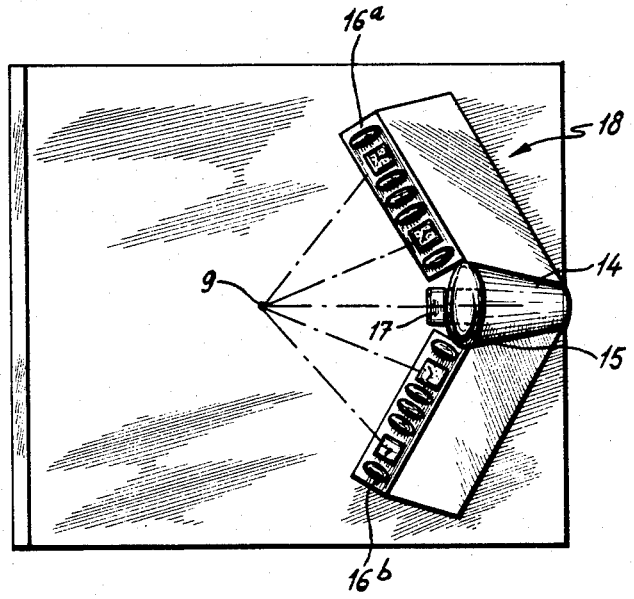
FIG. 2 shows an underview of the roof-ceiling of the steering-house according to section II—II of FIG. 1.

In FIG. 2 an underview of the roof-ceiling of the steering-house is illustrated, in which the center of vision 9 is indicated schematically. It can be seen that at both sides of the centrally positioned radar screen 15, two panels 16*a* and 16*b* are fitted including the necessary reading instruments. Both side panels 16*a* and 16*b* may together form with the radar screen 15 and the curve indicator 17 an integrated reading unit 18.

Figure 3:
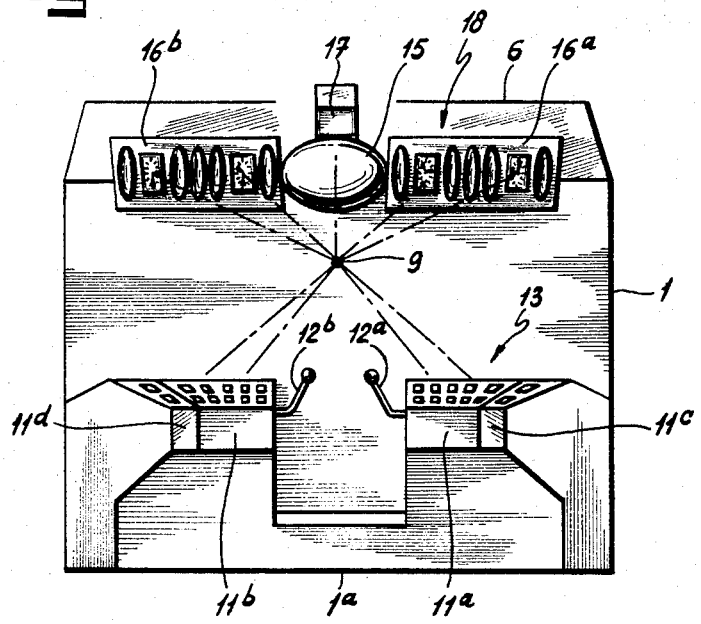
FIG. 3 shows a view from section III—III of FIG. 1.

In FIG. 3 a rear view is provided through the steering-house according to section III—III of FIG. 1. It will also be seen that the control console 11 is subdivided into two wings, which are fitted one at each side of the commander. The wings 11*a* and 11*b* are placed at the lefthand and righthand side in front of the commander and are between others fitted with control handles 12*a* and 12*b*. Since reading instruments are absent in the console, only control levers, turn- and push-buttons are fitted, which, due to their relatively small dimensions, can all be placed within hand reach of the sitting commander. Although it is not illustrated, straight in front of the commander both hand-controllable as well as foot-controllable control means may be placed.

Figure 4:
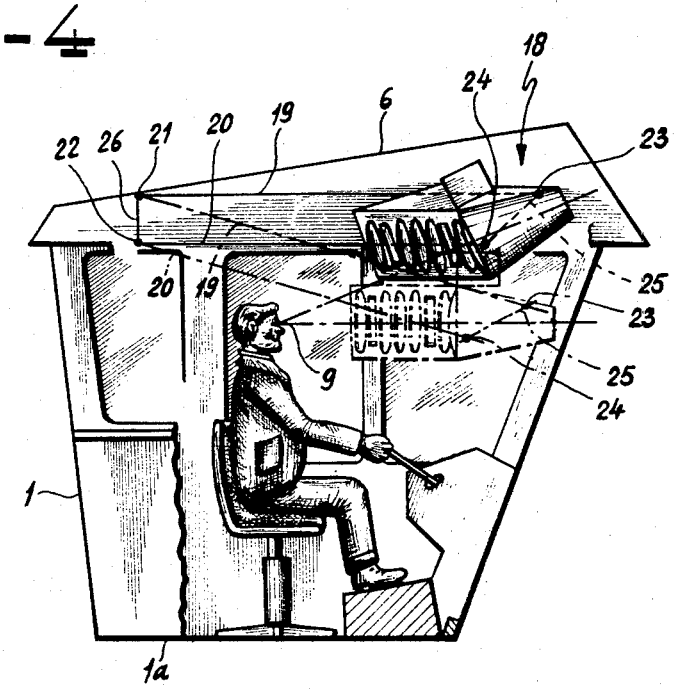
FIG. 4 shows an alternative execution of the steering-house according to FIG. 1, in which the reading unit is made movable in vertical direction.

In FIG. 4 a special execution of the reading unit 18 is illustrated, generally according to the previous description of the FIGS. 1, 2 and 3. The reading unit 18 in this case, however, is vertically movable in such a way, that the reading surfaces in all positions remain perpendicular to the direction of view of the commander. As an example for the necessary guiding means, a rod-quadrangle device is schematically illustrated. Two rods 19 and 20 are pivotingly connected at the points 21 and 22, which are fixed to the steering-house 1. The other ends of said rods 19 and 20 are pivotably connected to the reading unit 18 at the points 23 and 24. The rods 19 and 20 are parallel to each other in the highest position of the reading unit 18, as illustrated, but have a different length. The upper rod 19 is longer than the lower rod 20. The line 26 connecting the pivoting points 21 and 22, and the line 25 connecting the pivoting points 23 and 24, do not extend parallel to each other, but their extentions intersect each other in a point behind and below the center of view 9 of the commander. Due to the described dimensions of the rod quadrangle, the reading unit 18 will undergo during its vertical displacement a rotation, such that the line perpendicular to the reading surfaces continues to pass through the center of view 9 of the commander. This is indicated with dotted lines in FIG. 4. With the help of the described guiding means, shaped as rod quadrangles, the reading unit 18 can be brought downward at least so far, that it finds itself in the horizontal plane straight in front of the commander and that in case of "blind-navigation" it can be used in the same way as an artificial horizon for a pilot. If necessary the reading unit 18 eventually may be shifted further downwards. It will be clear that the rod quadrangle, as illustrated in FIG. 4, is merely a schematic indication of one of the many possible guiding means for the reading unit 18 to move it vertically up and down and keep it at the same time keep the reading surfaces perpendicular to the direction of view of the commander.

I claim:

1. A steering house for a ship or other floating vessel, said steering house having a front window slanting outwardly at its upper end and arranged to provide a free angle of vision between about 15° upward and at least about 30° downward from a horizontal plane through the center of vision for a seated commander, said steering house being provided with means for navigation and control of different functions in the ship, and comprising:

(a) an integrated reading unit, including a radar apparatus and other essential instrument means for supplying visual information for navigation and control of the ship, fitted near the roof-ceiling of said steering house and in front of the seated commander, and located in an upper position with an angle of vision for the seated commander between about 15° and 30° upward, wherein said instrument means are placed at either side of the radar apparatus screen, such that the instrument reading surfaces are oriented substantially perpendicular to the direction of view and from the center of vision of the seated commander and have a mainly spherical-sector shaped reading surface, said reading unit being vertically movable by the commander from said upper position to a position below said horizontal plane by suitable guiding means, which maintain said integrated reading unit surface during its vertical movement continuously substantially perpendicular to the direction of view of the commander, all positions of said reading unit being working positions; and (b) control means located in floor-mounted consoles at both sides of the seated commander, said control means being located within hand reach of the commander, so as to provide the commander with a free field of vision roundabout and especially in forward directions of the ship.

2. A steering house according to claim 1, wherein a free uninterrupted field of view is provided through said front window downward from the horizontal plane and center of vision of the commander at an angle between 0° and about 45°.

3. A steering house according to claim 1, wherein said guiding means for making said reading unit vertically movable in front of the center of vision of the commander being defined by at least one rod quadrangle, said reading unit being movable between a position against the roof-ceiling of the steering house and a position slightly below the horizontal plane whereby said rod quadrangle maintains said reading unit during its vertical movement continuously substantially perpendicular to the direction of view of the commander.

4. A steering house according to claim 1, wherein the distance between the reading unit and the center of vision of the commander is maintained generally constant.

5. A steering house according to claim 1, wherein the steering house includes a roof-ceiling, which extends from its highest point near the front side of the steering house, and said roof-ceiling slopes backwards and downwards to form a front upper space for said integrated reading unit.

6. A steering house layout for a ship or other floating vessel, said layout comprising:

(a) visual indicating means defined by an assembly of instruments in two instrument panels containing displays for navigation and control of the ship, said instrument panels being disposed at either side of at least one main radar unit to provide an instrument panel assembly having a mainly spherical-sector shaped reading surface observable by a seated commander, said instrument panel assembly being vertically movable from a position near the roof-ceiling of said steering house and above a horizontal plane located at the eye level of the commander to a lower position below said horizontal plane by suitable guiding means, which maintain said instrument panel reading surfaces substantially perpendicular to a direction of view and from the center of vision of the seated commander during the vertical movement of the instrument panel assembly;

(b) control means for said ship disposed in floor mounted consoles beneath and separate from the instrument panel assembly; and (c) a chair located at a central position in the steering house and proximate to said instrument panel assembly and to said control means to define a seated position for the commander, whereby the commander is able to sit while viewing said instrument panel assembly and manipulating said control means, so as to provide a free field of view for the commander roundabout and especially in forward directions of the ship.

7. The ship steering house layout of claim 6, wherein said instrument panel assembly is adapted for observation by the seated commander at an angle between about 15° and 30° upward from a horizontal plane of vision of the commander.

8. The ship steering house layout of claim 6, wherein the instruments and displays for said visual indicating means disposed at either side of said main radar screen are combined into a unitary instrument assembly, said instrument assembly being movable vertically in front of the commander by said guiding means defined by at least one rod quadrangle; said instrument assembly being traversable between a position against the ceiling of the steering house and generally above the center of vision of the commander and the lower position, said rod quadrangle being adapted to maintain said instrument assembly continuously perpendicular to the direction of view of the commander during the vertical movement and to maintain a generally constant distance between said instrument assembly and the commander.

9. The ship steering house layout of claim 6, wherein said guiding means for said instrument assembly being defined by at least one rod quadrangle; wherein said rod quadrangle comprises a pair of rods pivotally connected each at a first end to said steering house and each connected at a second end to said instrument assembly, said rods being defined as an upper rod having a greater length than a corresponding lower rod, each of said rods being substantially parallel to one another at their highest position, lines joining respective pivot points at said steering house and at said instrument assembly being non-parallel and when extended intersect at a point behind and below the center of vision of the commander, and said vertical displacement of said instrument assembly allowing a line perpendicular to said assembly to continue to pass through the center of vision of the commander.

10. A steering house for a ship or other floating vessel, said steering house having a front and side windows slanting outwardly at their upper ends and a roof-ceiling having its highest point near the steering house front side and slanting backwards and downwards therefrom, said steering house being arranged to provide a free angle of vision between about 15° upward and at least about 30° downward from a horizontal plane through the center of vision for a seated commander and provided with means for navigation and control of different functions in the ship, and comprising:

(a) an integrated reading unit, including a radar apparatus and other essential instrument means for supplying visual information for navigation and control of the ship, fitted in an upper position near the roof-ceiling of the steering house and in front of the seated commander, wherein said instrument means supplying visual information are placed at either side of the radar apparatus screen such that the instrument reading surfaces are oriented substantially perpendicular to the direction of view and from the center of vision of the seated commander, and have a mainly spherical-sector shaped reading surface, said reading unit being vertically movable by the commander from said upper position to a position below said horizontal plane by suitable guiding means provided by a rod quadrangle, which maintains said integrated reading unit surface during its vertical movement continuously substantially perpendicular to the direction of view of the commander, and at a generally constant distance between said reading unit and the commander, all positions of the reading unit being working positions;

(b) a centrally placed chair for seating the commander of the ship; and (c) control means located in floor-mounted consoles on both sides of the seated commander, said control means being located within hand reach of the seated commander, whereby the commander is provided with a free unobstructed field of vision roundabout and especially in forward direction of the ship for viewing at an angle between about 0° and 15° above the horizontal plane from the center of vision of the commander and for downward view at an angle between 0° and about 45° below the horizontal plane.

11. A ship steering house layout, comprising:

(a) visual indicating means defined by an assembly of instruments in an instrument panel containing displays useful for navigation and control of a ship, said instruments being disposed at either side of at least one radar unit and combined into a unitary instrument assembly having a spherical-sector shaped reading surface, said assembly being movable in the up and down direction in front of a commander by guide means defined by a rod-quadrangle; said instrument assembly being traversable between a position against the ceiling of the steering house and at a generally higher level than the center of vision of a commander and an eventually lower position, said guide means being adapted to maintain said instrument assembly continuously perpendicular to the direction of view of the commander during said upward and downward movement and to maintain a generally constant distance between said indicating means and the commander;

(b) manual control means disposed beneath and separate from said instrument panel assembly; and (c) a chair located at a central position in the steering house and proximate to said instrument assembly and to said control means to define a seated position for the commander, whereby the commander is able to sit while viewing said instrument assembly and manipulating said control means, so as to provide a free field of view for the commander roundabout and especially in forward directions of the ship.

12. A ship steering house layout, comprising:

(a) an instrument panel assembly containing displays useful for navigation and control of a ship, said instrument panel assembly being vertically movable by a rod quadrangle to provide all instruments in a position perpendicular to the direction of view of a commander, wherein said rod quadrangle comprises a pair of rods pivotally connected at a first end to said steering house and at a second end to said instrument panel assembly, said rods being defined as an upper rod having a greater length than a corresponding lower rod, each of said rods being parallel to one another at their highest position, whereby lines joining respective pivot points at said steering house and at said instrument panel assembly are non-parallel and when extended intersect at a point behind and below the center of vision of the commander, and vertical displacement of said instrument panel assembly allowing a line perpendicular to said instrument panel assembly to pass through the center of vision of the commander;

(b) manual control means being disposed within the ship steering house beneath and separate from said instrument panel assembly; and (c) a chair located at a central position in the steering house and proximate to said instrument panel assembly and to said control means to define a seated position for the commander, whereby the commander is able to sit while viewing said instrument panel assembly and manipulating said control means, so as to provide a free field of view for the commander roundabout and especially in forward directions of the ship.

13. A steering house for a ship or other floating vessel, said steering house having a front and side windows slanting outwardly at their upper ends and a roof-ceiling having its highest point near the steering house front side and slanting backwards and downwards therefrom, said steering house being arranged to provide a free angle of vision between about 15° upward and at least about 30° downward from a horizontal plane through the center of vision for a seated commander, said steering house being provided with means for navigation and control of different functions in the ship, and comprising:

(a) an integrated reading unit, including a radar apparatus and other essential instrument means for supplying visual information for navigation and control of the ship, fitted in an upper position near the roof-ceiling of said steering house and in front of the seated commander, said integrated reading unit being located in said upper position within an angle of vision of the seated commander between about 15° and 30° upward, wherein said instrument means are placed at either side of the radar apparatus screen, such that the instrument reading surfaces are always oriented substantially perpendicular to the direction of view and from the center of vision of the seated commander and having a mainly spherical-sector shaped reading surface, said reading unit being vertically movable by the commander from said upper position to a position below said horizontal plane by suitable guiding means provided by a rod quadrangle, which maintains said integrated reading unit during its vertical movements continuously perpendicular to the direction of view of the commander, wherein said rod-quadrangle comprises a pair of rods pivotally connected each at a first end to said steering house and each connected at a second end to said instrument assembly, said rods being defined as an upper rod having greater length than a corresponding lower rod, each of said rods being substantially parallel to each other at their highest position, lines joining respective pivot points at said steering house and at said instrument assembly being non-parallel and when extended intersect at a point behind and below the center of vision of the commander, and said vertical displacement of said instrument assembly allowing a line perpendicular to said assembly to continue to pass through the center of vision of the commander, all positions of the reading unit being working positions;

(b) a centrally placed chair for seating the commander; and (c) control means located in floor-mounted consoles at both sides of the seated commander, said control means being located within hand reach of the seated commander, whereby the seated commander is provided with a free unobstructed field of vision roundabout and especially in forward directions of the ship.

* * * * *